United States Patent [19]

De Winter et al.

[11] Patent Number: 5,028,006

[45] Date of Patent: Jul. 2, 1991

[54] SPRAY NOZZLE FOR SPRAY GUN FOR FORMING A POLYURETHANE LAYER ON A SURFACE

[75] Inventors: Hugo De Winter, Gentbrugge; Bernard Debaes, Damme-Sijsele; Philippe Buyck, Serskamp, all of Belgium

[73] Assignee: Recticel, Belgium

[21] Appl. No.: 495,188

[22] Filed: Mar. 19, 1990

[30] Foreign Application Priority Data

Mar. 20, 1989 [BE] Belgium ..... 08900299

[51] Int. Cl.[5] ..... B05B 7/10

[52] U.S. Cl. ..... 239/399; 239/487

[58] Field of Search ..... 239/399, 402, 403, 404, 239/474, 472, 473, 494–497, 487–489

[56] References Cited

U.S. PATENT DOCUMENTS

| | | | |
|---|---|---|---|
| 1,059,615 | 4/1913 | Kennedy | 239/488 X |
| 1,650,128 | 11/1927 | Hubbard | 239/494 X |
| 2,044,720 | 6/1936 | Fletcher | 239/399 |
| 2,961,171 | 11/1960 | Walsh | 239/491 X |
| 2,974,881 | 3/1961 | Garday | 239/474 X |
| 3,073,533 | 1/1963 | Weinbronner et al. | 239/399 |
| 3,078,047 | 2/1913 | Enemark | 239/472 X |
| 3,130,910 | 4/1964 | Sill | 239/404 |
| 3,558,053 | 1/1971 | Hrubl | 239/488 X |
| 4,474,331 | 10/1984 | Aprea et al. | 239/488 |

FOREIGN PATENT DOCUMENTS

| | | | |
|---|---|---|---|
| 360136 | 11/1920 | Fed. Rep. of Germany | 239/491 X |
| 48607 | 7/1986 | Japan | 239/399 |
| 273996 | 9/1960 | Netherlands | 239/399 |
| 385 | of 1886 | United Kingdom | 239/399 |
| 521677 | 5/1940 | United Kingdom | 239/399 |
| 584060 | 1/1947 | United Kingdom | 239/488 |
| 1575917 | 10/1988 | United Kingdom | 239/400 |

*Primary Examiner*—Andres Kashnikow
*Assistant Examiner*—Kevin Weldon
*Attorney, Agent, or Firm*—Sughrue, Mion, Zinn, Macpeak & Seas

[57] ABSTRACT

A spray nozzle for spray gun for forming a polyurethane layer on a surface by spraying the reaction components for obtaining this polyurethane. A spray piece (21) with a funnel-shaped cavity (27) is connected to a supply channel (19) of the reaction components and flows out in a cylindrical channel (29) which connects this cavity (27) to a spray opening 22. A core (17) is detachably placed in the spray piece (21) and allows the reaction components and/or the already formed polyurethane to be fed according to a screw or whirling movement through the spray opening. The core has a conical part which rests against an inner conical wall of the cavity. Formed in the conical core part are spiraled grooves (23) which impart a screw or whirling motion to the reaction components and which are in communication with respective core borings (40) which open into the supply channel (19) at a common point. A funnel-shaped diffuser (33) is connected to the spray opening (22) which allows to realize a divergent liquid jet, the core (17) having slanting borings (40) which extend from the supply channel (19) to the grooves (23).

13 Claims, 5 Drawing Sheets

SPRAY NOZZLE FOR SPRAY GUN FOR FORMING A POLYURETHANE LAYER ON A SURFACE

BACKGROUND OF THE INVENTION

The invention relates to a spray nozzle for spray gun for forming a polyurethane layer on a surface by spraying the reaction components for obtaining this polyurethane, comprising a spray piece with a substantially funnel-shaped cavity which, on the one hand, is connected with its widest side to a supply channel of said reaction components and, on the other hand, flows out at its narrowest side in a substantially cylindrical channel having a length between 0.1 and 2 mm, which connects this cavity with a spray opening, a core being detachably placed in the spray piece which allows to lead the reaction components and/or the already formed polyurethane substantially according to a screw or whirling movement through said spray opening.

The invention specially relates to a spray nozzle for spraying, according to the technique of the so-called "airless two-component system without solvent", an elastomer layer of polyurethane, which is preferably light stable and serves especially as an aesthetic covering, such as the lining of a car.

Due to the relatively high viscosity of such a reaction mixture, the relatively considerable thickness of the polyurethane layer, which can be applied advantageously on said surface by one single spray gun passage, and finally the necessary quick gelation of the polyurethane for avoiding the run off of the reacting mixture on the mould surface under the influence of the gravity force, it has been determined that the construction of the spray nozzle of the used spray gun has an important influence on the nature of the obtained polyurethane layer. The spray nozzle can then also be responsible for the fact that micro-air bubbles remain enclosed in the gelified polyurethane layer and, moreover, due to a heterogenity in the spraying of the mixture on the surface, irregularities as for density and other physical characteristics, such as the tone of the so formed layer, can arise.

Hence the invention aims mainly to present a spray nozzle for spray gun having a relatively simple construction and which is consequently easy to reproduce and allows to obtain a constant spray pattern for a well determined reaction mixture, whereby it becomes possible to avoid above mentioned problems on an industrial scale, and thus to obtain a perfect, gelified polyurethane layer on a surface, especially of a mould, by spraying a liquid reaction mixture which comprises polyol and isocyanate and which has preferably a viscosity between 20 and 2000 centipoises.

To this end a funnel-shaped diffuser is connected, in the spray nozzle according to the invention, to a spray opening, which allows to form a divergent liquid jet.

Advantageously, the diffuser has a top angle comprised between 40° and 160°, preferably between 80° and 120° and with particular preference of about 90°.

In another embodiment of the invention, the core is mounted at the entry of a funnel-shaped cavity, having a tapered part directed towards this cavity, grooves spirally oriented with respect to the axis of said tapered part being provided in the conical wall of this part, which grooves connect the funnel-shaped cavity to the supply channel via cylindrically shaped borings which end, on the one hand, in these grooves and, on the other hand, substantially centrally in the side of the core turned away from the cavity.

In a more specific embodiment of the invention, the grooves are equally distributed over said conical wall of the concerned core part, their number varies from two to ten and the inclination angle of these grooves, with respect to the axis of the core, varies from 15° to 60° and increases as a function of the number of grooves.

Other particularities and advantages of the invention will become apparent from the following description of some special embodiments of the spray nozzle according to the invention; this description is only given by way of example and does not limit the scope of the invention; the reference numerals, used hereafter in the description, relate to the annexed drawings figures.

DETAILED DESCRIPTION OF PREFERRED EMBODIMENTS

Figure 1:
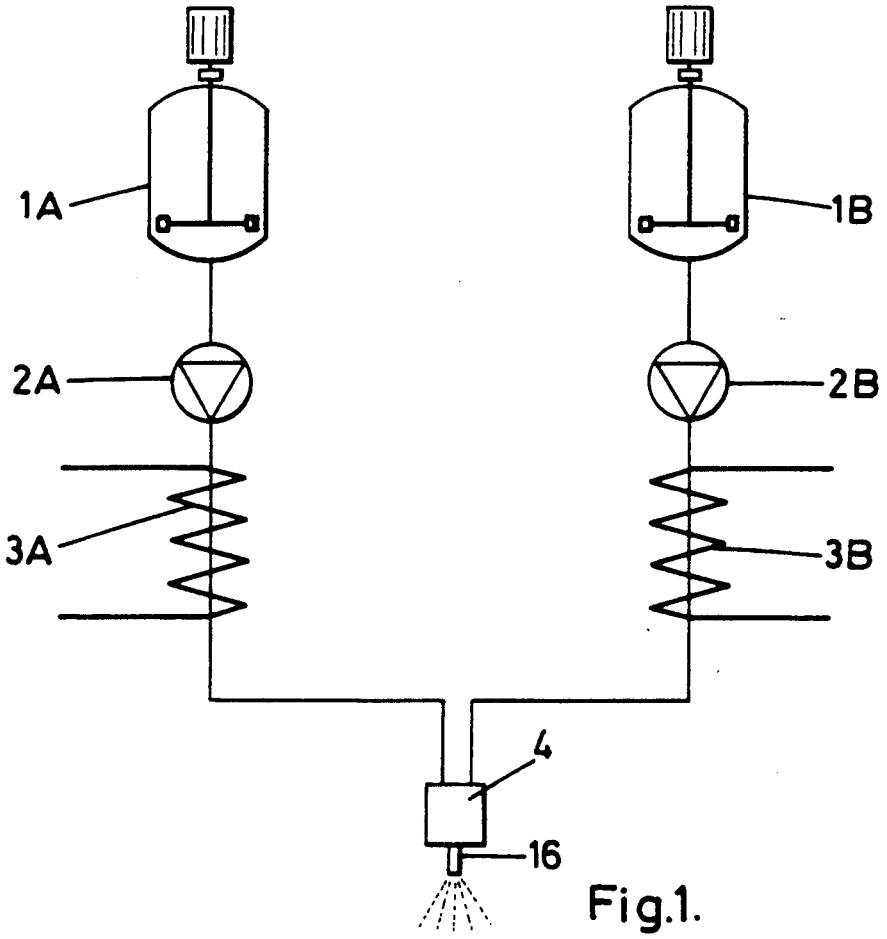
FIG. 1 is a schematic representation of a device for spraying a reaction mixture to form a polyurethane layer according to the technique of the so-called "airless two-component system without solvent".

In these different figures, the same reference numerals relate to the same or analogous elements.

The invention relates to a special spray nozzle construction forming the mouthpiece of a spray gun for forming a gelified polyurethane layer on a suitable mould surface.

This spray nozzle is especially intended for forming, in a mould, a light stable polyurethane elastomer layer having a minimum thickness of 0.3 mm, and preferably of about 0.5 to 2 mm, so that a print is obtained which serves as aesthetic covering, especially for garnishings in the interior of cars. This elastomer layer is in an advantageous manner formed according to the so-called "airless two-component system" without or substantially without a solvent.

FIG. 1 represents schematically a device for applying this technique.

In a first step, the two components, namely polyol and isocyanate, are dosed from a stirrer tank 1A, 1B respectively, by means of a dose-measuring pump 2A, 2B respectively, so as to be warmed up then appropriately, in a second step, in a heat exchanger 3A and 3B respectively before being mixed in a movable spray gun 4 provided with a spray nozzle 16. A jet of the thus obtained reaction mixture is sprayed from this spray nozzle 16 on a mould surface so as to form said elastomer layer.

This reaction mixture forms a film and/or a rain of droplets, the largest part of which has an average diameter (Medium Volume Diameter) higher than 100 microns and preferably higher than 500 microns, according to the ASTM E 779-18 norms.

Figure 2:
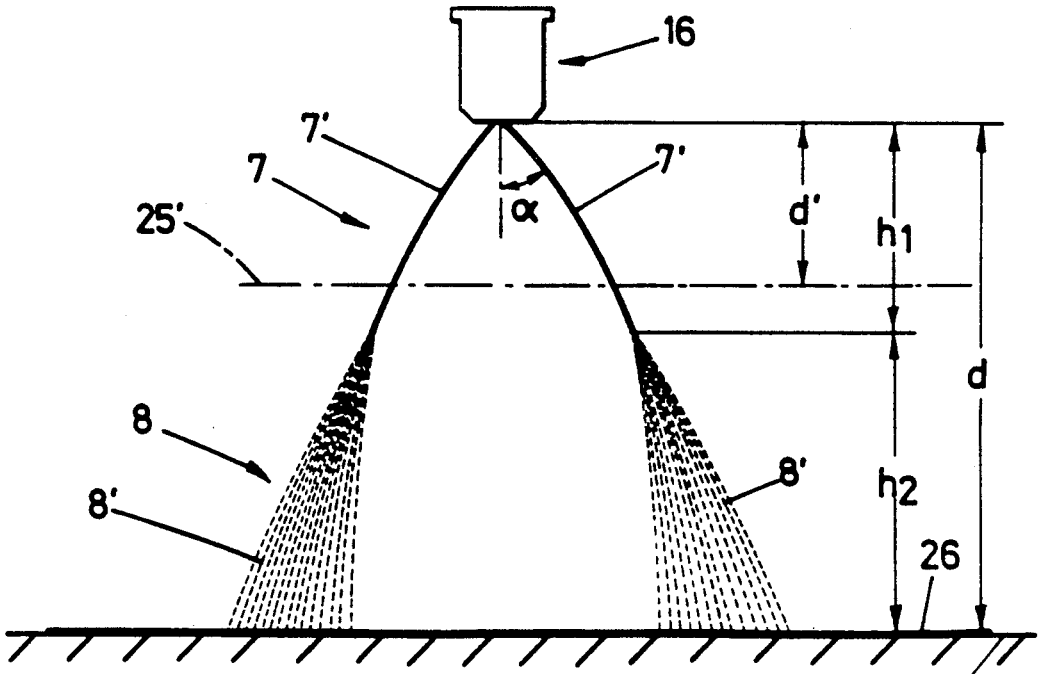
FIG. 2 is a schematic representation of a longitudinal section through a conical liquid jet obtained by applying the spray nozzle according to the invention.

As it has been represented in FIG. 2, the liquid jet, which is sprayed out of the spray nozzle 16, consists generally of two parts 7 and 8, the physical aspect of which being essentially different. So the part 7, which is nearest to the spray nozzle, consists of a film 7' extending according to a conical surface with circular cross-section, whereas this film falls apart into droplets 8' in part 8.

Generally it is tried to maintain a distance d, between the spray nozzle 16 and the surface on which the elastomer has to be formed, which is comprised between 0.5 cm and 30 cm and preferably between 15 cm and 20 cm.

FIG. 2 shows in an advantageous manner, in full lines, a first case in which the surface 25, to be covered with an elastomer layer, is disposed at a distance d from the spray nozzle 16, which is greater than the high $H_1$ of the reaction mixture jet and, in mixed lines, a second case wherein the surface 25' is disposed at a distance d', smaller than this height $h_1$. In the first case, the layer 26 is formed by the droplets 8' and in the second case by the film 7'.

For one and the same spray nozzle, the height $H_1$ of this part 7 is mainly function of the viscosity of the reaction mixture, the angle $\alpha$ and the flow rate of the sprayed liquid.

Thus these parameters are advantageously controlled in such a manner that the height $h_1$ of this part is situated between 0.5 and 20 cm.

Moreover, it has to be noted that preference is given to a spraying of this mixture as a film extending from the spray nozzle 16 according to a hollow, slightly bulged cone, the top angle of which being comprised between 5° and 80° and preferably between 20° and 40°.

If however, for example for practical reasons, the reaction mixture has to be mainly spread as droplets, there has been determined that favourable results are obtained when the largest part of these droplets 8' have a relatively large average diameter, which is mostly comprised between 100 and 5000 microns, and preferably between 500 and 3000 microns.

Compared with the height of the part 7, the height $h_2$ of this part 8 can be relatively important if the reaction mixture is sprayed on the surface to be covered at a relatively limited flow rate.

As has been schematically represented in FIG. 2, in the part 8, in which droplets are formed, these droplets spread out, starting from a certain distance from the part 7, in a substantially uniform way over a large part of the cone cross-section, in contrast with that what is the case in the part 7 wherein this liquid extends mainly in the shape of a hollow cone.

The FIGS. 3 to 7 relate to a first embodiment of a spray nozzle according to the invention.

The spray nozzle comprises a spray piece 21 with a funnel-shaped cavity which, on the one hand, is connected with its wider side to a supply channel 19 of the reaction components for obtaining the polyurethane and, on the other hand, has its narrower side in a cylindrical channel 29 communication having a length between 0.1 and 0.2 mm, and connecting this cavity with a spray opening 22.

In this spray piece 21 there is detachably placed a core 17 which allows the reaction components and/or the already partly formed polyurethane to be fed substantially according to a screw or whirling movement through the spray opening 22.

The spray piece 21 has a threaded cylindrical outer wall 10, and is screwed in a corresponding recess 11 of the body 12 of the spray nozzle. In this body the supply channel 19 extends parallel to the longitudinal axis 13 of the body 12 and communicates, at one end thereof, with the recess 11 near the cavity 27 of the spray piece 21 and, at the other end thereof, with a coupling sleeve 14 provided with an internal thread 36 and intended to be connected to a not shown supply pipe for the reaction components coming from the tanks 1A and 1B (see FIG. 1).

The spray piece 21 is screwed in the recess 11 of the body 12 by means of a special, not shown spanner comprising two jags which project into two diametrally located openings 15 of the spray piece 21 and which thus allow to tighten the latter in the recess 11.

The spray nozzle according to this first embodiment of the invention is especially characterized by the fact that a funnel-shaped diffuser 33 is connected to the spray opening 22, which allows a stable, divergent liquid jet to be formed, as has been represented in FIG. 2.

This diffuser 33 has a top angle which is advantageously comprised between 40° and 160°, preferably between 80° and 120° and with a particular preference for about 90°.

Figure 3:
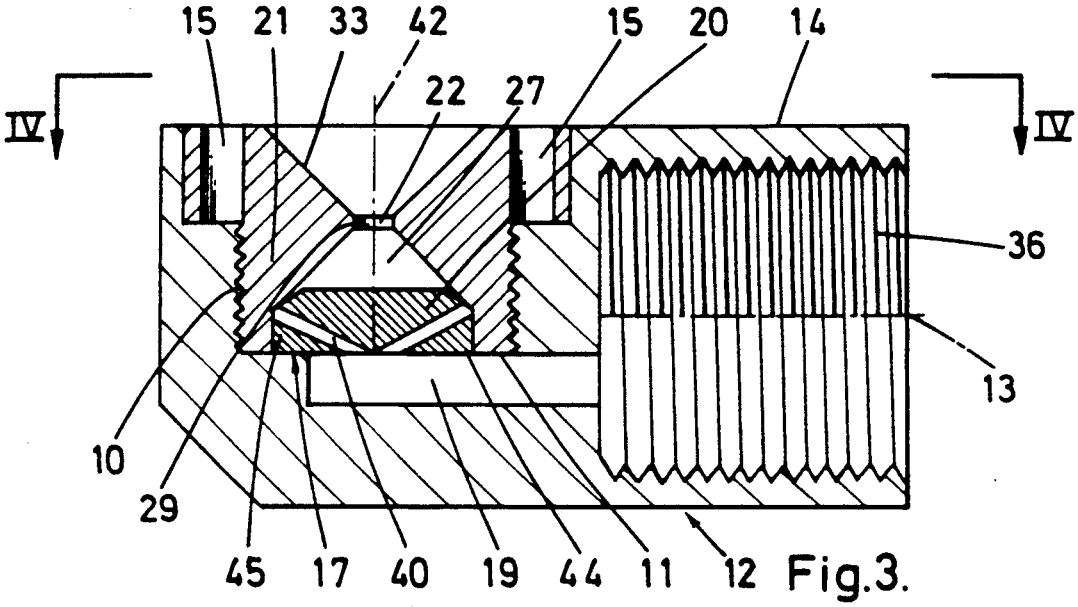
FIG. 3 is a longitudinal section, along line III—III in FIG. 4, of a first embodiment of the spray nozzle according to the invention.
Figure 4:
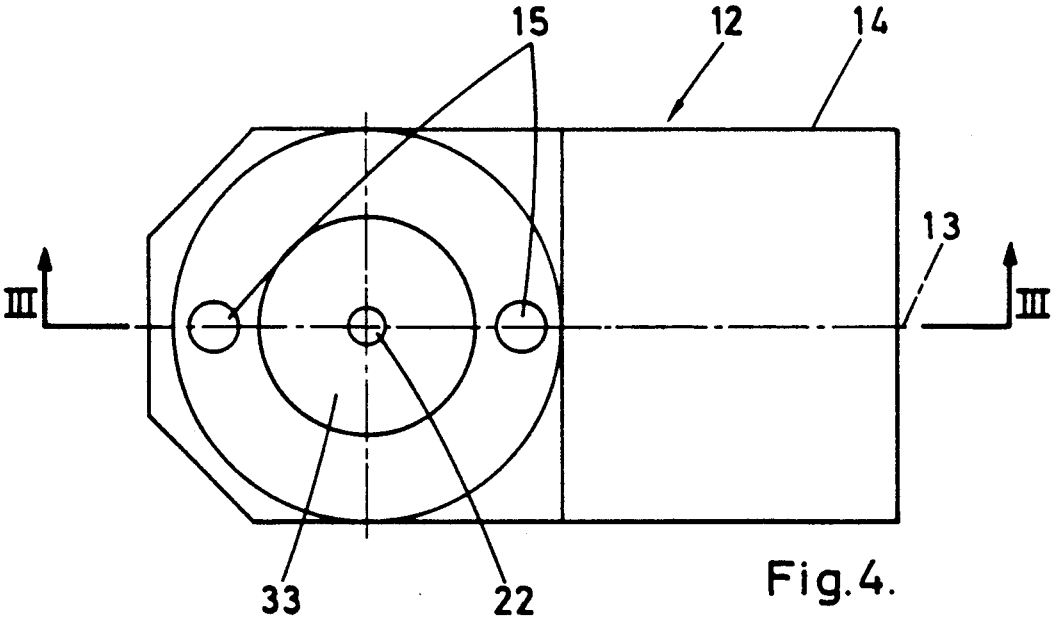
FIG. 4 is a front view, along line IV—IV in FIG. 3, of the first embodiment.

Further, in a specific embodiment of the invention and as it has been represented anyway in FIG. 3, the top angle of the funnel-shaped cavity 27 and the one of the diffuser 33 are substantially equal.

Further, the length of the cylindrical channel 29 is usually comprised between 0.4 and 0.9 mm and is preferably about 0.65 mm, whereas the diameter of this channel is usually comprised between 0.7 and 1.1 mm and is preferably of about 0.9 mm.

The choice of these different dimensions is of course dependent on the nature of the reaction mixture to be sprayed and on the flow-rate of the latter.

Figure 5:
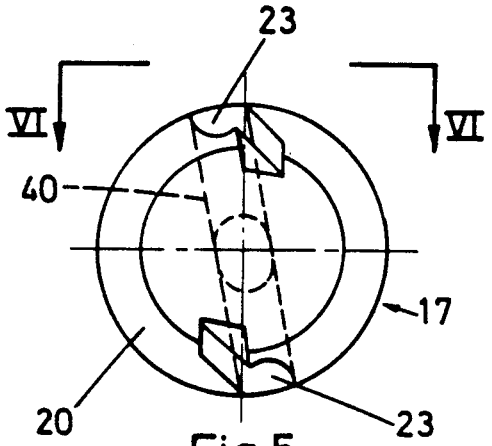
FIG. 5 is, on a larger scale, a view along line V—V in FIG. 6 of a special part of the spray nozzle according to FIGS. 3 and 4.
Figure 12:
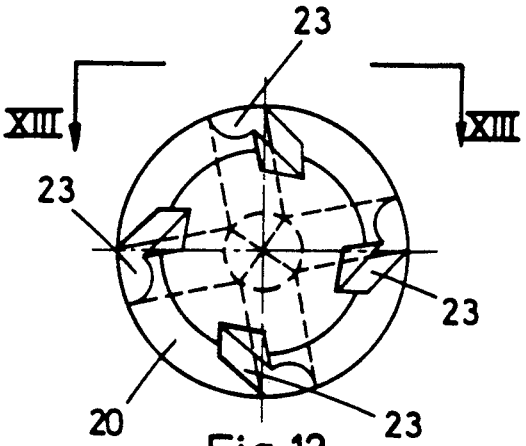
FIG. 12 is, also on a larger scale, a view, along line XII—XII in FIG. 13, of another part of the spray nozzle according to this second embodiment.
Figure 6:
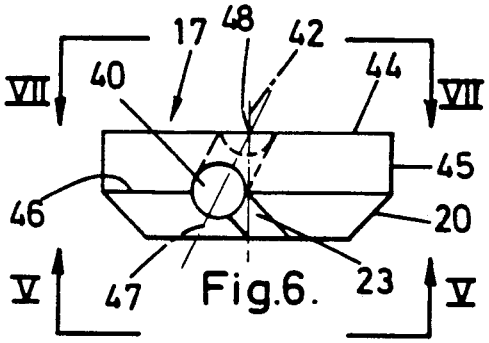
FIG. 6 is a side view of the same part along line VI—VI in FIG. 5.
Figure 13:
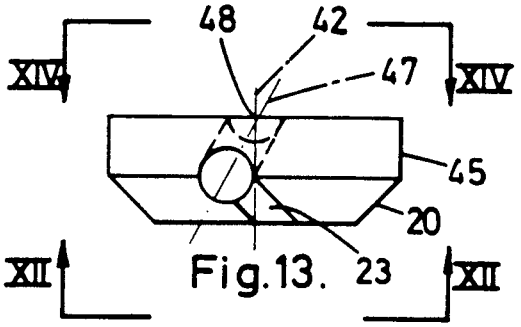
FIG. 13 is a side view along line XIII—XIII in FIG. 12.
Figure 7:
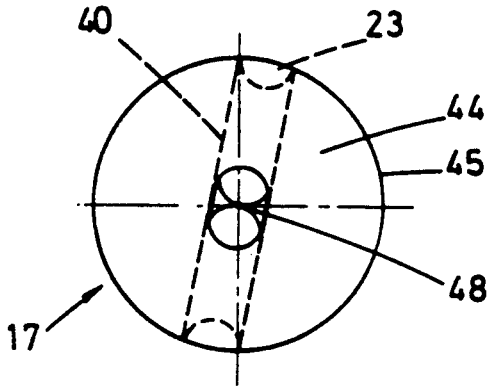
FIG. 7 is a view along line VII—VII in FIG. 6.
Figure 14:
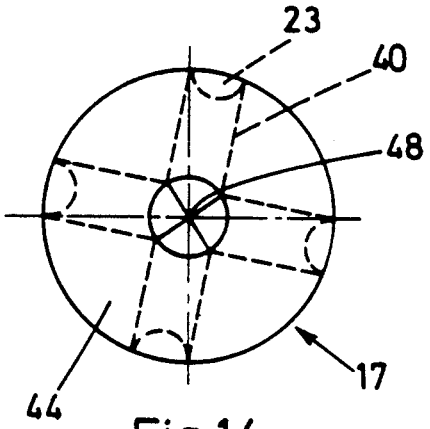
FIG. 14 is a view along line XIV—XIV in FIG. 13.
Figure 8:
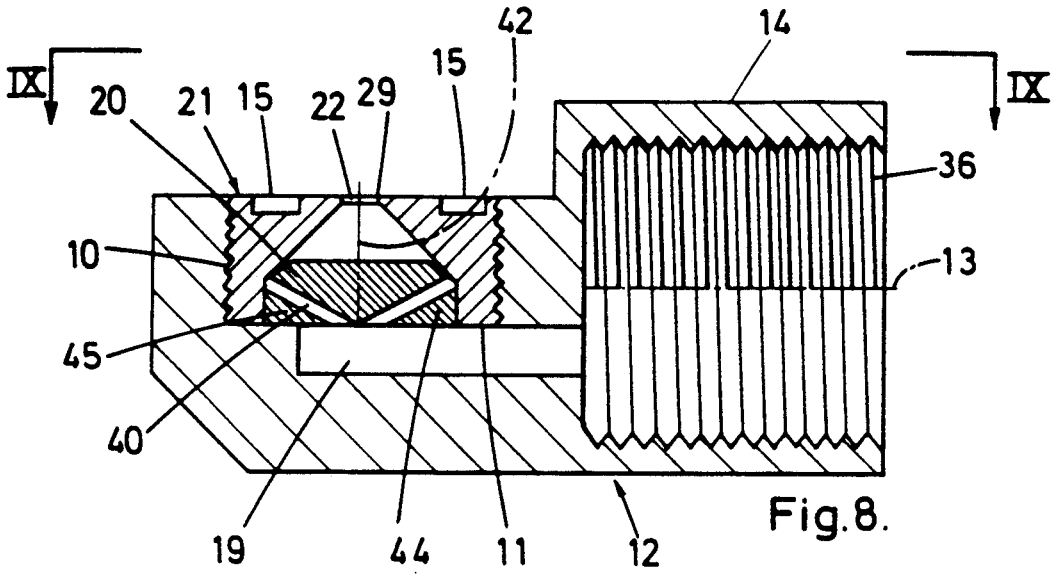
FIG. 8 is a longitudinal section, along line VIII—VIII in FIG. 9, of a second embodiment of a spray nozzle according to the invention.
Figure 9:
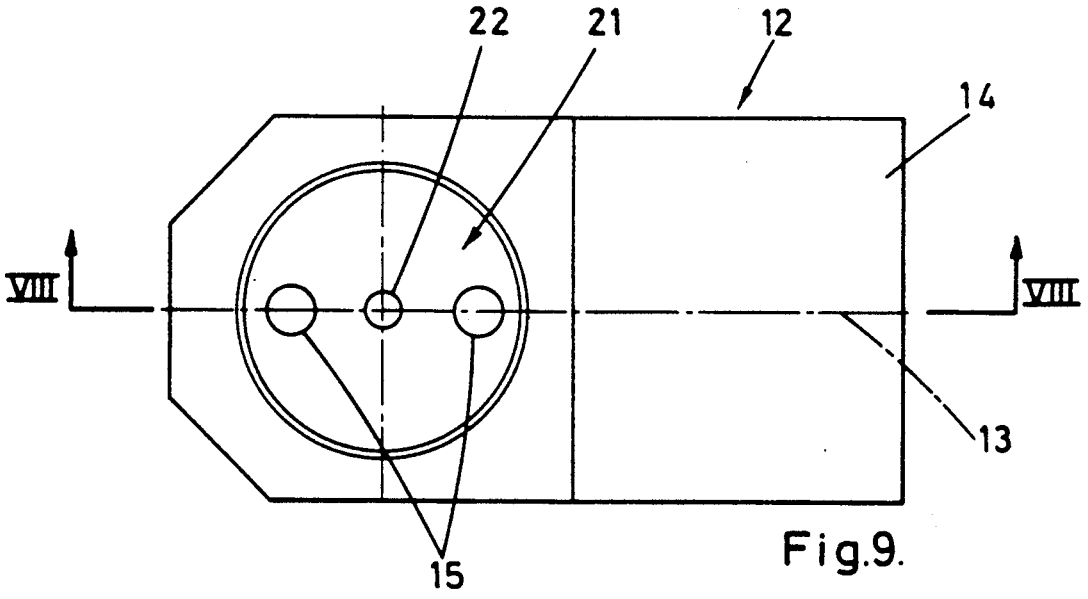
FIG. 9 is a front view along line IX—IX in FIG. 8.
Figure 10:
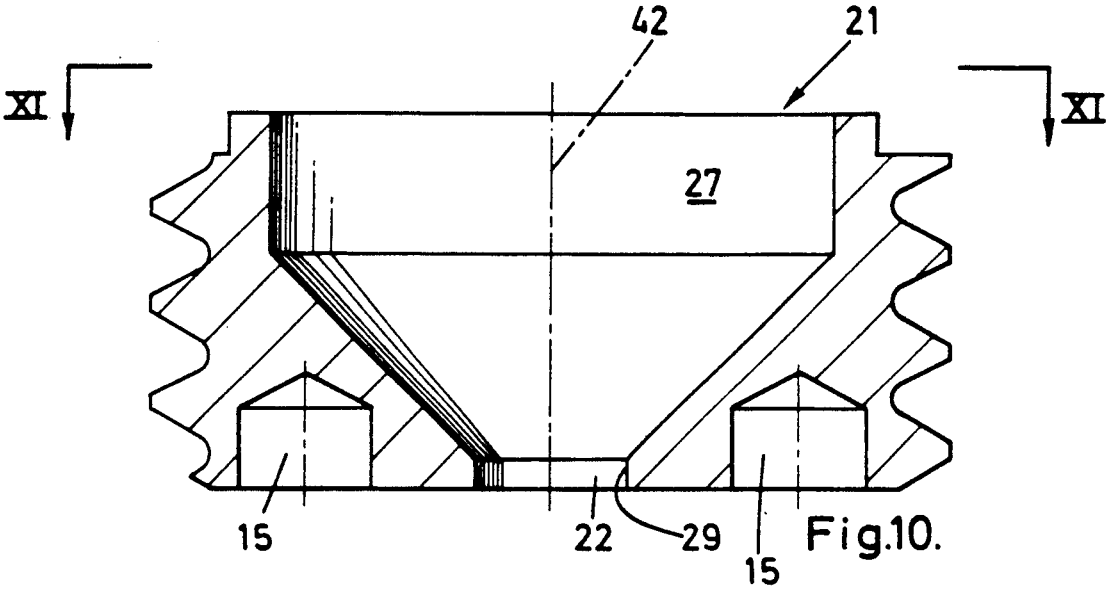
FIG. 10 is, on a larger scale, a cross-section, along line X—X in FIG. 11, of a special part of the spray nozzle according to this second embodiment.
Figure 11:
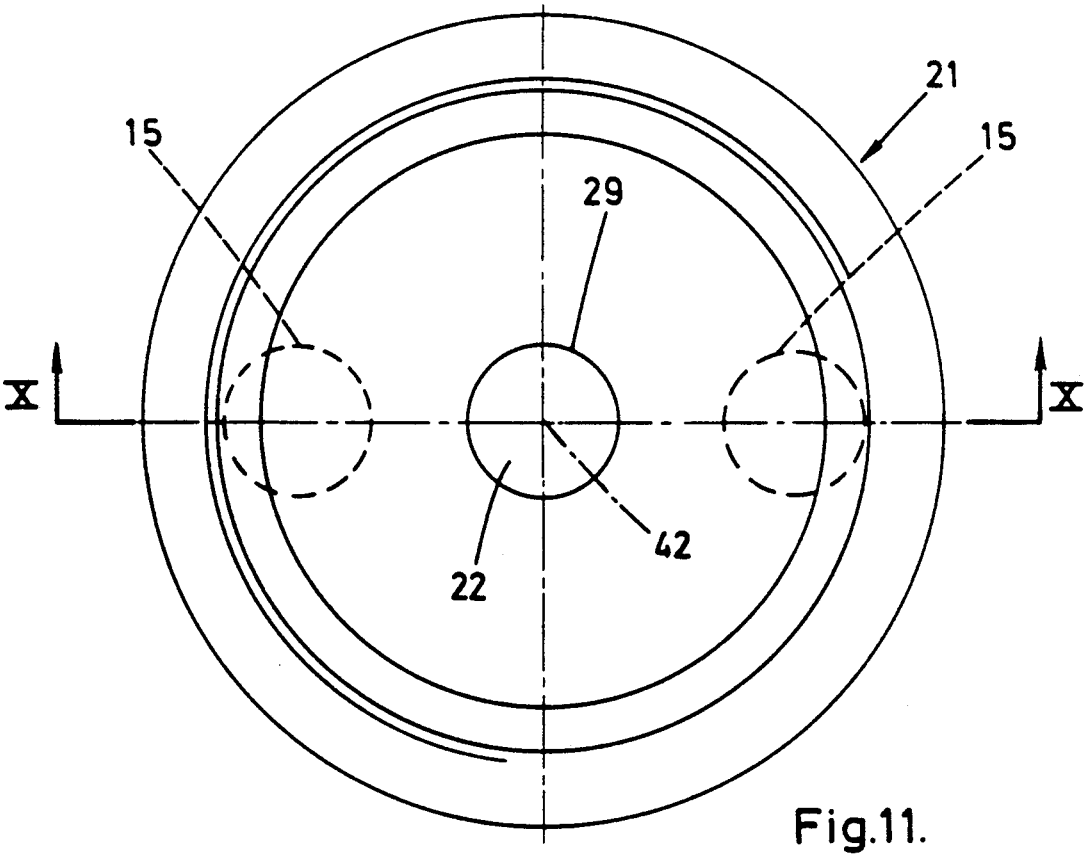
FIG. 11 is a view along line XI—XI in FIG. 10.

As represented on a larger scale in FIGS. 5 to 7, the core 17 comprises in this first embodiment a cylindrical part 45 and a tapered part 20 which rests in the entry of the funnel-shaped cavity 27 of the spray piece 21.

In the conical wall of this part 20 two grooves 23, spirally orientated with respect to the axis 42 of this latter part, are provided which connect the funnel-shaped cavity 27 to the supply channel 19 via cylindrical borings 40 which flow out, on the one hand, in these grooves 23 and, on the other hand, centrally in the core base 44 turned away from the cavity 27.

These grooves are located substantially diametrally to each other.

So the core 17 has a completely symmetrical construction and is, due to its simplicity, very easy to reproduce. This concerns especially the diameter and the direction of the slanting borings 40 and the width of the grooves 23.

It has been observed that this core 17 allows one to obtain a very stable and regular spray pattern and this in such a way that, as represented in FIG. 2, the liquid cone, formed during spraying, shows a circular cross-section at right angles to its axis and a wall thickness which is everywhere constant in this cross-section.

The inclination angle $\alpha$ of these grooves 23 with respect to the axis 42 of the core 17, is in many cases very important.

Very good results have been obtained for a core with two grooves, such as in this first embodiment, when this angle is about 30°.

A second embodiment of a spray nozzle 16 according to the invention is represented in FIGS. 8 to 14.

This spray nozzles is distinguished from the first embodiment, as shown in FIGS. 3 to 7, by the fact that the spray piece 21 shows no diffuser and that the core is provided with four grooves 23 which are located two by two diametrally opposite in the conical wall of the part 20. Further, the inclination angle $\alpha$ of the grooves 23 is of 45° instead of 30°.

According to the invention it has been generally determined that the number of grooves 23, which can be equally distributed over said conical wall of the part 20, can advantageously vary from 2 to 10, the inclination angle of these grooves with respect to the core axis 42 varying from 15° to 60° and increasing as a function of the number of grooves.

In a preferred embodiment of the invention, the axis 47 of each boring 40 extends from the centre 48 of the base 44 of the cylindrical part 45 of the core 17 to about the dividing line 46 between the cylindrical part 45 and the tapered part 20. Moreover, the diameter of the cylindrical borings 40 is preferably about twice the width of the grooves 23. In this way the feeding of the grooves 23 takes usually place under the most favourable conditions.

As a reaction agent which can be used by means of the spray nozzle according to the invention, one can mention those which have been described in Belgian patents 852337; 882058 and patent application No. 8700792 which belong to the applicant.

Of course, the invention is in no way limited to the above described and in the annexed drawings represented embodiments, so that within the scope of the invention several modifications can be taken into consideration amongst others with respect to the dimension of the components of the spray nozzle and the number of grooves and borings. Therefore, the second embodiment can for example also been provided with a diffuser.

What is claimed is:

1. A spray nozzle for a spray gun for forming a polyurethane layer on a surface by spraying reaction components for obtaining said polyurethane, said nozzle comprising:

a spray piece with a substantially funnel-shaped cavity which has its wider side connected to a supply channel of said reaction components, and which has its narrower side in flow communication with a substantially cylindrical channel having a length between 0.1 and 2 mm and connecting said cavity with a spray opening of said nozzle; and a core comprising a conical part detachably mounted in said spray piece in such a manner that said conical part is directed towards said cavity and rests against an inner conical wall of said cavity; said conical part having a plurality of grooves for injecting said reaction components with a screw or whirling movement into said cavity and through said spray opening;

said core also comprising a plurality of cylindrically shaped borings in flow communication with only respective ones of said grooves and with said supply channel at a common single point in a core side directed away from said cavity, each boring communicating at one end thereof only with a different respective one of said grooves and at an opposite end thereof with said common single point in said supply channel.

2. A spray nozzle according to claim 1, further comprising a funnel-shaped diffuser means, connected to said spray opening, for forming a divergent liquid jet; and wherein said diffuser has a top angle comprised between 40° and 160°.

3. A spray nozzle according to claim 2, wherein a top angle of said funnel-shaped cavity and said top angle of said diffuser means are substantially equal.

4. A spray nozzle according to claim 1, wherein said cylindrical channel has a length comprised between 0.4 and 0.9 mm.

5. A spray nozzle according to claim 1, wherein said cylindrical channel has a diameter comprised between 0.7 and 1.1 mm.

6. A spray nozzle according to claim 1, wherein said grooves are in a conical wall of said conical part and are spirally oriented with respect to an axis of said conical part; wherein said grooves are equally distributed over said conical wall of said conical part; wherein the number of grooves is from two to ten; and wherein an inclination angle of said grooves, with respect to said axis, is from 15° to 60° and increases as a function of the number of grooves.

7. A spray nozzle according to claim 6, wherein said conical part has only two grooves which extend diametrically opposite to each other, and wherein said inclination angle is about 30°.

8. A spray nozzle according to claim 6, wherein said conical part has only four grooves which are located two by two diametrically opposite, and wherein said inclination angle is about 45°.

9. A spray nozzle as claimed in claim 1, wherein each of said borings ends substantially centrally in said core side.

10. A spray nozzle according to claim 2, wherein said top angle is between 80° and 120°.

11. A spray nozzle according to claim 10, wherein said top angle is about 90°.

12. A spray nozzle according to claim 4, wherein said length is about 0.65 mm.

13. A spray nozzle according to claim 5, wherein said diameter is about 0.9 mm.

* * * * *